United States Patent [19]

Pliml, Jr., Frank V.

[11] Patent Number: 5,069,013

[45] Date of Patent: Dec. 3, 1991

[54] CASEMENT WINDOW FASTENING SYSTEM

[75] Inventor: Pliml, Jr., Frank V., Arlington Heights, Ill.

[73] Assignee: Illinois Tool Works Inc., Glenview, Ill.

[21] Appl. No.: 568,186

[22] Filed: Aug. 16, 1990

[51] Int. Cl.[5] ..... E06B 1/04

[52] U.S. Cl. ..... 52/214; 52/769; 52/773; 292/340

[58] Field of Search ..... 52/213, 214, 216; 292/80, 86, 87, 340, 773, 769

[56] References Cited

U.S. PATENT DOCUMENTS 2,837,785 6/1958 May ..... 52/769
2,840,202 6/1958 Hehr ..... 52/214
3,137,901 6/1964 Malachowski et al. ..... 52/773
3,196,998 7/1965 Owen ..... 52/773

*Primary Examiner*—Richard E. Chilcot, Jr.
*Assistant Examiner*—Kien T. Nguyen
*Attorney, Agent, or Firm*—Schwartz & Weinrieb

[57] ABSTRACT

A fastening arrangement for securing a window within a sash has a clip, with an extended arm mounted upon the sash so as to engage a pocket within a receptacle anchored to and recessed within the frame, which clip arm nests within the said pocket so as to secure the frame within the sash. The clip arm is readily releasable from its engaged position with respect to the frame receptable so as to readily permit the release, removal and replacement of the frame and window as may be necessary.

20 Claims, 1 Drawing Sheet

CASEMENT WINDOW FASTENING SYSTEM

FIELD OF THE INVENTION

The present invention relates generally to a spring-clip arrangement for mounting windows, and more particularly, the mounting arrangement is utilized for casement windows, and eliminates screws extending through a frame and sash so as to anchor the window in place. The frame and window are easily inserted and anchored within the sash; and, removal of the frame and window is accomplished with a knife edge or thin shim member but without the necessity of screw removal, which often requires sawing or chiseling to dislodge such screws.

BACKGROUND OF THE INVENTION

A window fastener utilizing a clip secured to a sash so as to engage serrations within the base of a window frame for permanently securing the frame in position within a wall section is noted in U.S. Pat. No. 2,840,202 to T. Hehr. A clip is securely anchored to the sash with the upturned end of the clip protruding toward the inner part of the window opening for engagement with the serrations defined within the bottom of the frame assembly. Similarly, U.S. Pat. No. 2,840,203-E. T. Hehr illustrates a clip arrangement with the clip anchored to the window frame. A protruding tongue engages the so as to permanently secure the window within the window opening. The assemblies taught in these patents provide permanent anchoring of the frames and windows within the window opening without consideration for their subsequent removal for repair and/or replacement. More particularly, it is noted that these fastening apparatus are specifically utilized for the installation of prefabricated window frames.

An alternative window-fastening arrangement for anchoring a window frame is provided in U.S. Pat. No. 1,570,351 to Hultin, and utilizes a leaf spring, which is fixed or bent within a notch, for engagement with the window frame and an opening defined within the window sash or window-opening. This apparatus securely anchors the windows in place, but the channels associated with the spring-retention notch are provided for a binding liquid so as to secure the window. There is no apparent consideration for window and frame removal for either repair or replacement.

Various clip apparatus, which cooperate with windows, frames, sashes or moldings, are available for securely anchoring the windows and frames, or for temporarily anchoring the frame or molding. Exemplary of a temporary securing item is the arrangement in U.S. Pat. No. 1,906,884-B. C. Place, for garnish moldings, which arrangement finds particular application for retention of a molding within an automobile body or frame. In U.S. Pat. No. 3,170,507-G. J. Kleinkanecht, a window frame-and-screen combination utilizes a clip for inserting a screen and retaining it against the window frame. U.S. Pat. No. 3,137,901-F. Malachowski et al. illustrates a spring clip insertable through means of a port or passage and extending into a cavity of a sash for securement therein. The clip has an extended arm for anchoring a window.

A snap-in glass setting arrangement is disclosed in U.S. Pat. No. 2,837,785-May, which utilizes a spring clip internally anchored within a sash for retention of a molding or glass-frame lip so as secure the glass and frame within an open window structure. The glass and frame are only removable from engagement with the retention clip by insertion of a lever into a key slot so as to pry the stop member from engagement with the spring clip, which requires the lip member to be pivotally attached to a lever arm for fulcruming about a side edge. Thus, although the glass is removable, there is potential for damage to both the sash and frame utilizing such a forceful removal of a glass member. U.S. Pat. No. 2,916,112-A. H. Kiehl discloses a metal window construction utilizing springs positionable within an attaching strip of a window construction, which springs provide a centering function for the window frame inserted within the wall opening prior to attachment of window flanges to the exterior of the building wall.

Illustrative of a molding-clip assemblage especially for a windshield is the clip shown and disclosed in U.S. Pat. No. 4,349,993-Tanaka et al. for mounting a molding about the periphery of the windshield. The clips have a retaining claw for securing the outer edge of the molding and a retaining mechanism prevents the clip from extraction from the recess part of the base after being inserted therein. A release lever extending from the claw is movable so as to release the clip.

SUMMARY OF THE INVENTION

The present invention provides a spring-clip arrangement for mounting a window and frame within a sash of a window opening without utilization of screws extending through the frame and sash. The spring-clip arrangement is especially useful for rapid installation, ease of alignment, and ease of removal for maintenance or replacement of casement windows. A metal fastener clip is preferably anchored within the sash with a flexible arm displaced from and extending at an angle with respect to the sash periphery. This arm contacts and mates with a stepped receptacle, preferably plastic, within the perimeter of the window frame and ratchets up the stepped wall so as to secure the window frame within the sash. Alternatively, the fastener clip may be anchored within a slot defined within the sash. A thin shim member inserted between the frame and sash deflects the arm from its mated position within the plastic receptacle and allows removal of the window and frame from the sash mounted within a building opening.

BRIEF DESCRIPTION OF THE DRAWINGS

Various other objects, features, and attendant advantages of the present invention will become more apparent from the following detailed description, when considered in connection with the accompanying drawings, in which like reference characters designate like or corresponding parts throughout the several views, and wherein.

DETAILED DESCRIPTION OF THE ILLUSTRATED EMBODIMENTS

Figure 1:
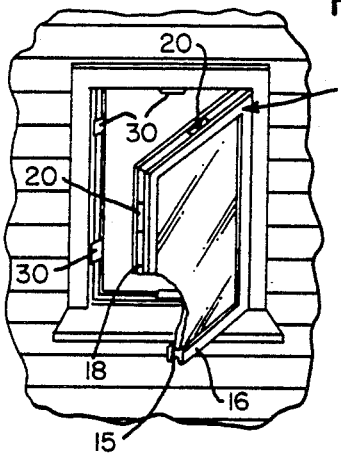
FIG. 1 is a perspective view of a casement window and frame inserted within a sash of a building or home with a plurality of clips and receptacles disposed within their respective perimeters.
Figure 4:
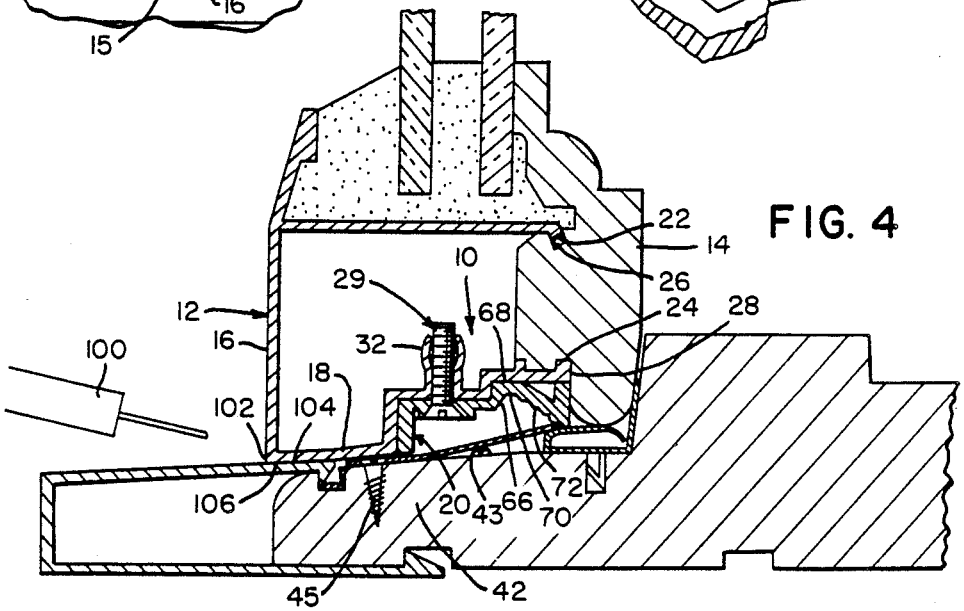
FIG. 4 is an end view in cross section of a mated fastener arrangement in FIG. 1; and, FIG. 5 is a perspective view of an alternative embodiment of the spring clip of FIG. 4.

A fastening apparatus 10 for securing a window frame 12 within a window sash 42, is illustrated in FIGS. 1 and 4, which apparatus is particularly utilized with casement windows although applicable to other assemblies. An exemplary illustration of a plurality of apparatus 10 positioned about the periphery of a window, is noted in FIG. 1 with clips 30 positioned within sash 42 and receptacles 20 are secured within frame 12. It is contemplated that a plurality of fastener arrangements 10 would be disposed about the perimeter of sash 42 and frame 12, however, only a single fastener arrangement will be described in detail.

In FIG. 4, receptacle 20 is mounted within the periphery of window frame 12, which has an outer wall 16 and a mating or inner wall 14. Lower edge or periphery 18 of outer wall 16 has an irregular cross-sectional configuration or outline and a cavity 13 so as to accommodate receptacle 20. Tabs 22 and 24 of extruded outer wall 16 nest within frame inner wall slots 26 and 28 for retention and anchoring of inner wall 14 and outer wall 16. However, the particular form and structure of outer frame 16 and inner frame 14 are merely exemplary, and not a limitation of the present invention. Receptacle 20 in FIGS. 2 and 4, which is formed so as to correspond to the configuration of outer wall 16, is secured to frame 12 at frame wall periphery 18 by means of screws 29 extending through receptacle apertures 54 and 56 so as to engage a screw socket 32 integrally formed within frame 12. Thus, receptacle 20 is securely anchored to and recessed within periphery 18 for engagement by means of spring clip lip 84 so as to secure window frame 12 within sash 42.

Figure 2:
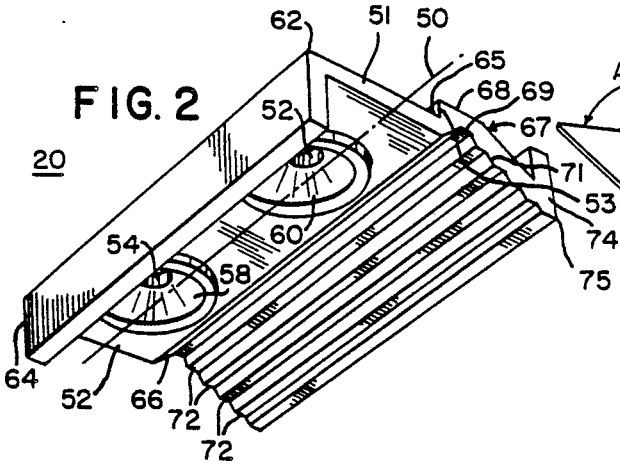
FIG. 2 is a bottom view in perspective of the receptacle of the fastener arrangement in FIG. 1.

Receptacle 20 in FIG. 2 has first wall 51 with a generally rectangular outline, a longitudinal axis 50 and a generally planar lower face 52. Apertures 54 and 56 extending through wall 51 are centered along a longitudinal axis, which is parallel to axis 50. As noted in FIGS. 2 and 4, apertures 54 and 56 are, respectively, formed with conical wells 58 and 60 tapering inwardly from face 52. Conical wells 58, 60 provide a pilot-like arrangement for insertion of a screw or bolt through the respective ports or apertures 54, 56, and also act as countersunk seats for the head of a bolt or screw anchoring receptacle 20 to frame 12. Sidewall 64 perpendicularly extends below planar surface 52 at first edge 62 of wall 51 serves as an abutment or reinforcing member so as to position and secure receptacle 20 to corresponding wall of the illustrated frame 12. Wall member 67 extends from wall 51 at second receptacle edge 65 opposite wall edge 64. Upper surface 68 of wall member 67 protrudes above wall 51 which forms a shoulder 53 so as to secure receptacle 20 within frame member 12. Lower face 66 is inclined from lower surface 52 and intersects with a second and oppositely inclined face 71 at intersecting shoulder 69. The intersecting faces 66 and 71 form a pocket 70 so as to receive a clip arm 84. A plurality of steps 72 are provided upon second inclined face 71 and are generally parallel to intersecting shoulder 69. A second sidewall 74, extends vertically from terminating edge 75 of second inclined face 71, which second sidewall is operable to anchor receptacle 20 within cavity 13. In this arrangement as noted in FIG. 4 receptacle 20 within cavity 13 is slightly angled from the horizontal plane but securely anchored therein by means of screw 29. Receptacle 20 may be any material, including plastics and metals, however, it is readily formable as a plastic shape and is securely anchored within the frame so as to avoid bending or fatigue.

Figure 3:
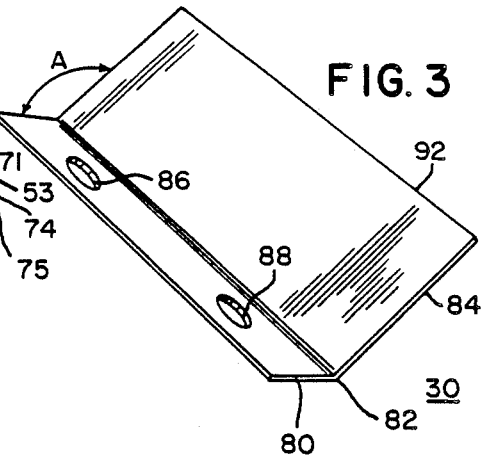
FIG. 3 is a plan view in perspective of the spring clip of the fastener arrangement in FIG. 1.

Spring clip 30 in FIGS. 3 and 4 has a lower or anchoring arm 80, which is a generally planar thin-wall sheet with first passage 86 and a second passage 88, intersecting with second arm 84 at shoulder or seam 82, wherein second arm 84 extends at an obtuse angle, A, from the horizontal plane of first arm 80. Second arm 84 has upper or contact edge 92 so as to contact and grip receptacle 20 as a result of engagement with steps 72. In the illustrated embodiment, second arm 84 is approximately three times the length of first arm 80, however, the length of either of the above arms 80, 84 are a design consideration and not a limitation.

In FIG. 4, first or lower arm 80 is positioned upon and anchored to a lower lip 43 of sash element 42 by means of a screw 45 extending through aperture 88. Alternatively, clip 40 of FIG. 5 may be secured to sash 42 by inserting lower arm 80 into a notch 44 defined within sash 42. Clips 30 and 40 may be fabricated from any suitable material, such as, for example, spring steel, so as to provide the flexural and strength characteristics adequate to be deflected during frame installation and strong enough to retain frame 12 within sash 42.

Figure 5:
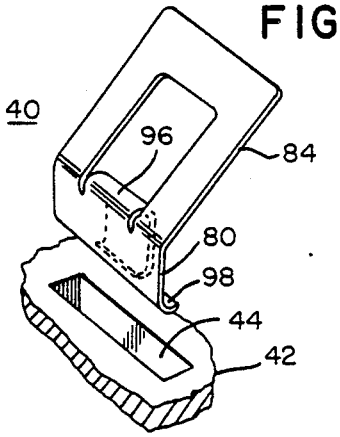

In FIG. 5, alternative embodiment spring clip 40 is an integral component with tongue 96 generally centrally stamped or formed from second arm 84 and bent so as to approximately meet and contact lower or inner surface 98 of first arm 80. The resultant spring clip 40 provides first arm 80 with a biasing member 96 for insertion and more secure gripping of the sidewalls of slot 44 defined within lower sash 42.

In the preferred embodiment, spring clip 30 and more particularly, lower arm 80, is mounted upon lower lip 43 of sash 42 and anchored therein by means of a screw or securing means 45 extending through apertures 86, 88. In this embodiment a flat-head screw is nested within passages 86, 88 so as to provide a generally smooth surface of first arm 80 upon sash 42. Alternatively, lower arm 80 may be anchored within sash 42 by inserting lower arm 80 into a notch 44 defined within sash 42 as illustrated in FIG. 5. As noted in FIG. 4, upper or second arm 84 extends at an angle from both lower or first leg 80 and sash 42 in a suitable direction so as to contact upper receptacle 20 at insertion of frame 12 in sash 42. Upon engagement of frame 12 and sash 42, second arm 84 of spring clip 30, which is biased upwardly away from sash lip 43, ratchets along steps 72 of wall 71 so as to engage receptacle 20 and anchor frame 12 within sash 42. Spring clip fastener arrangement 10 avoids added window-installation tool requirements and merely requires pressing frame 12 into sash 42 for mating engagement of clip 30 and receptacle 20, which expedites installation, securely anchors the window in position, and reduces the overall costs.

As noted, fastener arrangement 10 securely anchors frame 12 within sash 42 for retention therein. However, fastener arrangement 10 also permits easy removal of the frame-and-window arrangement merely by inserting a knife edge or thin shim member 100 within a space 102 defined between a first substantially planar surface 104 of frame 12 and a second substantially planar surface 106 of sash 42, which is disposed parallel to surface 104 of frame 12, so as to deflect second or upper arm 84 from engagement with receptacle 20. Deflection of arm 84 releases frame 12 for easy removal of the assembly for repair or replacement without the necessity of screw removal, which may require chiseling or sawing, and other damage frequently inherent to those operations.

While only specific embodiments of the invention have been described and shown, it is apparent that various alternatives and modifications can be made therein. It is, therefore, the intention of the appended claims to cover all such modifications and alterations as may fall within the scope and spirit of the invention.

What is claimed is:

1. A fastening arrangement for securing a window frame to a sash, comprising:

a receptacle defined within said frame, said frame including a first substantially planar surface leading to said receptacle defined within said frame; and means, fixedly mounted upon said sash and projecting into said receptacle of said frame, for engaging said receptacle of said frame so as to secure said frame to said sash, said sash including a second substantially planar surface which is disposed substantially parallel to said first substantially planar surface of said frame so as to define therebetween a space which is capable of receiving a tool by means of which said engaging means is accessible from a position external to said frame and sash so as to be disengageable from said receptacle so as to permit easy removal of said window frame from said sash.

2. A fastening arrangement as claimed in claim 1, wherein said means for engaging is a spring clip having a first arm with at least a first edge; and a second arm with at least a second edge, said first arm and second arm intersecting so as to form a seam, said second arm being angularly displaced from said first arm to a reference position, and wherein said second arm is engageable with said receptacle and deflectable from said reference position so as to secure said frame and sash.

3. A fastening arrangement as claimed in claim 2 wherein said receptacle has a first wall with a longitudinal axis, a first end, a second end, an upper surface, a lower surface, a first edge and a second edge, wherein said first and second edges are disposed generally parallel to said axis;

said first wall having at least one aperture;

a first inclined surface with an outer edge coupled to one of said first wall first and second edges;

a second inclined surface with a plurality of steps, said first and second inclined surfaces intersecting and defining a pocket for receiving said spring clip second arm, wherein said second arm ratchets upon said inclined surface steps so as to securely anchor said frame and sash.

4. A fastening arrangement as claimed in claim 3 wherein a counterbore is defined within said lower surface of said receptacle; and securing means extending through said receptacle aperture and nesting within said counterbore so as to engage said frame for anchoring said receptacle thereto.

5. A fastening arrangement as claimed in claim 5 wherein said securing means are screws with heads nestable within and contacting said counterbores so as to secure said receptacle upon said frame.

6. A fastening arrangement as claimed in claim 5 wherein said frame defines a recess and a passage open to said recess;

said receptacle is mountable within said recess so as to provide a generally unobstructed surface to said frame; and said screws have shanks extending through said receptacle apertures for threaded engagement with said frame passage to anchor said receptacle in said frame recess.

7. A fastening arrangement as set forth in claim 4, wherein:

said receptacle comprises a component of said fastening arrangement which is separate from said window frame and which is fabricated from a metal material.

8. A fastening arrangement as set forth in claim 4, wherein:

said receptacle comprises a component of said fastening arrangement which is separate from said window frame and which is fabricated from a plastic material.

9. A fastening arrangement as claimed in claim 3 further comprising second securing means;

said spring-clip first arm defining at least one throughport; and said second securing means extends through said through-port so as to engage said sash and secure said spring clip thereto.

10. A fastening arrangement as claimed in claim 9 wherein said second securing means are screws with flat heads matable with said first arm throughport so as to engage said sash for anchoring said spring clip and for providing a smooth uninterrupted surface along said first arm.

11. A fastening arrangement as claimed in claim 2 wherein said sash defines at least one slot; and said spring-clip first arm is matable with said sash slot so as to anchor and retain said spring clip within said sash so as to achieve said receptacle engagement.

12. A fastening arrangement as set forth in claim 2, wherein:

said second arm is displaced from said first arm by means of an obtuse angle defined therebetween; and said second arm has a length which is approximately three times the length of said first arm.

13. A fastening arrangement as set forth in claim 1, wherein:

said window frame comprises a frame member of a casement type window.

14. A fastening arrangement for securing a window frame upon a sash, comprising:

a receptacle with at least one aperture;

a spring-clip with a first arm and a second arm coupled along a boundary, wherein said first and second arms are angularly displaced with respect to each other;

first means for securing said receptacle upon said frame;

said frame defining at least one recess for receiving said receptacle and including a first substantially planar surface leading to said recess within which said receptacle is disposed, and further comprising a port communicating with said recess for receiving said first securing means extending through said receptacle aperture so as to mate with said frame port so as to anchor said receptacle within said recess of said frame; and second securing means for anchoring said spring clip at one of said first and second arms to said sash, and wherein the other one of said first and second arms is angularly displaced with respect to said one of said first and second arms so as to contact said receptacle in order to secure said frame to said sash;

said sash including a second substantially planar surface which is disposed substantially parallel to said first substantially planar surface of said frame so as to define therebetween a space which is capable of receiving a tool by means of which said other one of said first and second arms of said spring clip in contact with said receptacle is accessible from a position external to said frame and sash so as to be disengageable from said receptacle so as to permit easy removal of said window frame from said sash.

15. A fastener as claimed in claim 14 wherein said one of said first and second spring-clip arms and defines at least one throughport;

said second securing means extends through said so as to engage said sash and anchor said spring clip with said other one of said first and second spring-clip arms being angularly displaced from said sash and with respect to said one of said first and second spring-clip arms for engagement with said receptacle so as to secure said frame within said sash.

16. A fastener as claimed in claim 15 wherein said receptacle has an anchoring wall, a first inclined wall and a second inclined wall, wherein said first and second walls intersect along a longitudinal axis and at an angle so as to define a pocket therebetween;

one of said first and second walls having an outer edge coupled to said anchor wall; and the other one of said first and second walls defining a plurality of steps generally parallel to said longitudinal axis, which steps are engageable with said angularly displaced spring-clip arm so as to secure said frame within said sash.

17. A fastening arrangement as set forth in claim 15, wherein:

said second arm is angularly displaced with respect to said first arm by means of an obtuse angle defined therebetween; and said second arm has a length which is approximately three times the length of said first arm.

18. A fastening arrangement as set forth in claim 14, wherein:

said window frame comprises a frame member of a casement type window.

19. A fastening arrangement as set forth in claim 14, wherein:

said receptacle is fabricated from a metal material.

20. A fastening arrangement as set forth in claim 14, wherein:

said receptacle is fabricated from a plastic material.

* * * * *